US008644751B2

(12) United States Patent
Kodera et al.

(10) Patent No.: US 8,644,751 B2
(45) Date of Patent: Feb. 4, 2014

(54) HEATING DEVICE AND IMAGE FORMING APPARATUS USING THE SAME

(75) Inventors: Tetsuro Kodera, Kanagawa (JP); Naoyuki Egusa, Kanagawa (JP); Takashi Matsubara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 345 days.

(21) Appl. No.: 13/216,857

(22) Filed: Aug. 24, 2011

(65) Prior Publication Data

US 2012/0207500 A1 Aug. 16, 2012

(30) Foreign Application Priority Data

Feb. 10, 2011 (JP) ..... 2011-027501

(51) Int. Cl.
*G03G 15/20* (2006.01)

(52) U.S. Cl.
USPC ..... 399/337; 399/67

(58) Field of Classification Search
USPC ..... 399/336–337; 359/852; 362/302
See application file for complete search history.

(56) References Cited

U.S. PATENT DOCUMENTS 4,386,840 A * 6/1983 Garthwaite et al. ..... 399/337
5,113,223 A * 5/1992 Theodoulou et al. ..... 219/220
5,436,710 A 7/1995 Uchiyama
8,412,085 B2 * 4/2013 Kodera et al. ..... 399/335
8,433,231 B2 * 4/2013 Tanaka et al. ..... 399/336

FOREIGN PATENT DOCUMENTS

JP A-56-164375 12/1981
JP 59128569 A * 7/1984 ..... G03G 15/20
JP A-61-200567 9/1986
JP 07191560 A * 7/1995 ..... G03G 15/20
JP A-2010-217731 9/2010

* cited by examiner

*Primary Examiner* — Clayton E Laballe
*Assistant Examiner* — Leon W Rhodes, Jr.
(74) *Attorney, Agent, or Firm* — Oliff PLC

(57) ABSTRACT

A heating device includes an illuminating unit that applies laser light towards a strip-like illumination area formed along a direction crossing a direction of movement of a recording medium; and a reflecting member that surrounds the illumination area, the reflecting member reflecting again reflected light from the illumination area. The reflecting member has protruding reflecting surfaces that protrude continuously towards the recording medium along a widthwise direction crossing a longitudinal direction of the illumination area, the protruding reflecting surfaces being disposed side by side in the longitudinal direction of the illumination area. The protruding reflecting surfaces are positioned at substantially equal distances from the illumination area along the widthwise direction of the illumination area, and changed so that an entire or a portion of a cross-sectional shape along the longitudinal direction of the illumination area is curved or inclined.

15 Claims, 16 Drawing Sheets

HEATING DEVICE AND IMAGE FORMING APPARATUS USING THE SAME

CROSS-REFERENCE TO RELATED APPLICATIONS

This application is based on and claims priority under 35 USC 119 from Japanese Patent Application No. 2011-027501 filed Feb. 10, 2011.

BACKGROUND

Technical Field

The present invention relates to a heating device and an image forming apparatus using the same.

SUMMARY

According to an aspect of the invention, there is provided a heating device including an illuminating unit that applies laser light towards a strip-like illumination area formed along a direction crossing a direction of movement of a recording medium; and a reflecting member that surrounds the illumination area, the reflecting member reflecting again reflected light from the illumination area. The reflecting member has a protruding reflecting surfaces that protrude continuously towards the recording medium along a widthwise direction crossing a longitudinal direction of the illumination area, the protruding reflecting surfaces being disposed side by side in the longitudinal direction of the illumination area. The protruding reflecting surfaces are positioned at substantially equal distances from the illumination area along the widthwise direction of the illumination area, and changed so that an entire or a portion of a cross-sectional shape along the longitudinal direction of the illumination area is curved or inclined.

BRIEF DESCRIPTION OF THE DRAWINGS

Exemplary embodiments of the present invention will be described in detail based on the following figures, wherein.

DETAILED DESCRIPTION

General Description of Exemplary Embodiment

First, an exemplary embodiment of a heating device to which the present invention is applied will be schematically described.

Figure 1A:
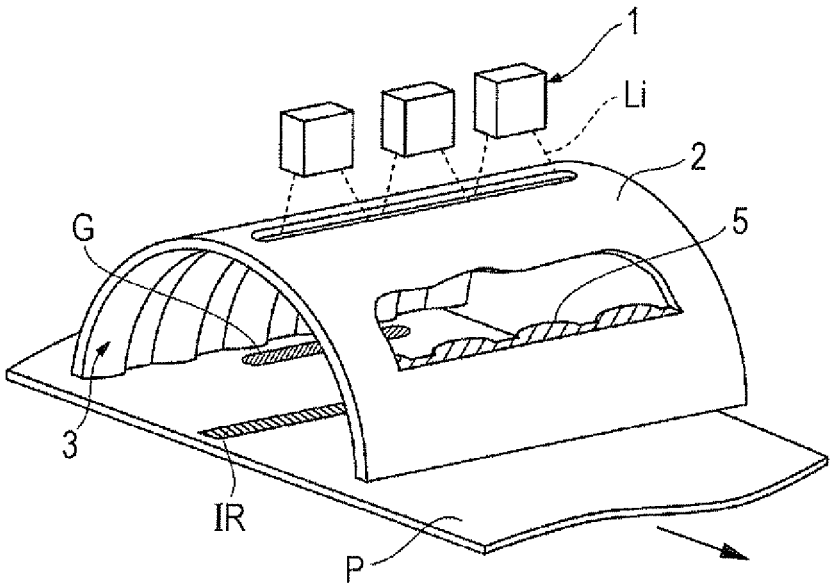
FIG. 1A illustrates a heating device according to a model of an exemplary embodiment of the present invention.
Figure 1B:
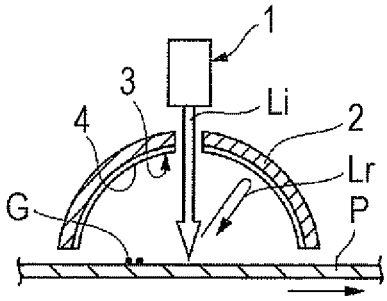
FIG. 1B is a sectional view of the heating device shown in FIG. 1A as seen in a direction along a widthwise direction of a recording medium.
Figure 1C:
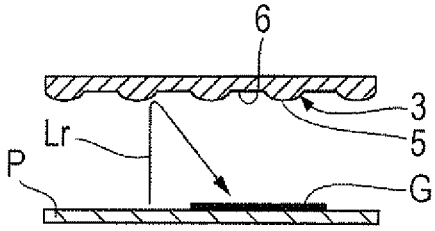
FIG. 1C is an enlarged sectional view of the heating device shown in FIG. 1A as seen from a direction of movement of the recording medium.

FIG. 1A is a perspective view illustrating a heating device according to a model of an exemplary embodiment of the present invention. FIG. 1B is a sectional view of the heating device shown in FIG. 1A as seen along a widthwise direction of a recording medium. FIG. 1C is an enlarged sectional view of the heating device shown in FIG. 1A as seen from a direction of movement of the recording medium.

In FIGS. 1A to 1C, the heating device includes illuminating units 1 and a reflecting member 2. The illuminating units 1 apply laser light Li towards a strip-like illumination area IR. The illumination area IR is provided in correspondence with a recording medium P on which an image G which is fixable by heating is formed, and is formed at a predetermined position on the recording medium P along a direction crossing a direction of movement of the recording medium P. The reflecting member 2 is provided so as to surround the illumination area IR, and reflects again reflected light Lr coming from the illumination area IR towards the recording medium P. The reflecting member 2 has multiple protruding reflecting surfaces 3 that protrude towards the recording medium P along a widthwise direction crossing a longitudinal direction of the illumination area IR, and that are arranged side by side in the longitudinal direction of the illumination area IR. Each protruding reflecting surface 3 has a continuous surface 4 and a changing surface 5. The continuous surfaces 4 are consecutively formed so as to be positioned at substantially equal distances from the illumination area IR along the widthwise direction of the illumination area IR. Each changing surface 5 changes so that an entire or a portion of a cross-sectional shape of the continuous surface 4 along the longitudinal direction of the illumination area IR is curved or inclined.

Here, typical examples of recording medium P are a continuous recording medium (sheet roll, continuous paper) and a cut sheet.

The illuminating units 1 may be any illuminating units as long as they are capable of applying the laser light Li. Typical examples of illuminating units 1 are array-laser-type illuminating units in which multiple light sources are disposed in a row in a direction crossing the direction of movement of the recording paper P. However, the illuminating units 1 may be disposed so that a plural number of the illumination areas IR are provided along the direction of movement of the recording medium P.

Further, although, for the illuminating units 1, any illuminating units may be used as long as the laser light Li is applied from one light source in the direction of movement of the recording medium P, light sources may be provided in the direction of movement so that, for example, the same illumination area IR is illuminated or illumination areas IR at different locations along the direction of movement are illuminated. Still further, although it is desirable to provide the illumination area IR in one straight line along a direction crossing the direction of movement of the recording medium P, the illumination area IR may be divided, in which case the illuminating units 1 are provided in accordance with the divided illumination area IR.

Although the reflecting member 2 has one integrated structure, the reflecting member 2 may be divided into portions.

The reflecting member 2 has the protruding reflecting surfaces 3 that are disposed side by side in the longitudinal direction of the illumination area IR. A characteristic feature of each protruding reflecting surface 3 is that each protruding reflecting surface 3 has a continuous surface 4 and a changing surface 5. From the viewpoint of efficient use of the reflected light Lr (including scattered light) and the viewpoint of manufacturing, it is desirable to provide each of the protruding reflecting surface 3 along the entire area of the reflecting member 2 along the widthwise direction of the illumination area IR. However, each of the protruding reflecting surface 3 may be provided at at least a portion where the reflected light Lr having a high intensity and coming from the illumination area IR is capable of being reflected.

Further, the cross-sectional shape of each protruding reflecting surface 3 is not particularly limited to, for example, a curved shape, a V shape, and a trapezoidal shape. The cross-sectional shape of each protruding reflecting surface 3 may be any shape as long as each protruding reflecting surface 3 includes a curved or an inclined changing surface 5.

By providing such protruding reflecting surfaces 3, as shown in, for example, FIG. 1C, the changing surfaces 5 of the protruding reflecting surfaces 3 do not allow the reflected light Lr from the illumination area IR of the recording medium P to return to its original reflection position, and causes the reflected light Lr to spread (to be scattered) at other locations in the illumination area IR. Therefore, the protruding reflecting surfaces 3 cause the reflected light Lr having a high intensity and coming from a portion where the image G does not exist to travel towards a portion where the image G exists. In contrast, when the changing surfaces 5 are not provided, it becomes easier for the reflected light Lr having a high intensity and coming from the illumination area IR to return to the original reflection position, or to return to a location close to the original reflection position.

Therefore, by providing the protruding reflection surfaces 3, the reflected light Lr having a high intensity and coming from a location where the image G does not exist is scattered over a wide width to an the area where the image G exists, so that such reflected light Lr also strikes the image G, thereby contributing to fixing of the image G. Since the reflected light Lr from the recording medium P has a higher intensity when a reflection angle of the reflected light Lr from the reflection position is small, the reflected light Lr having a high intensity is scattered over a wider range by the changing surfaces 5 of the protruding reflecting surfaces 3.

The protruding reflecting surfaces 3 may be provided at portions of the reflecting surfaces along the longitudinal direction of the illumination area IR. In such a case, it is desirable to continuously provide the protruding reflecting surfaces 3 adjacent to each other in the longitudinal direction of the illumination area IR from the viewpoint of reducing the influence of a layout of the image G. Here, the reflected light Lr from each location in the illumination area IR is scattered. Further, from the viewpoint of increasing illumination efficiency, it is desirable to discontinuously provide the protruding reflecting surfaces 3 so as to be separated from each other in the longitudinal direction of the illumination area IR. In this case, connecting surfaces 6 between the protruding reflecting surfaces 8 that are spaced apart from each other make it easier for the reflected light Lr from the illumination area IR to return to each reflection position.

Therefore, if the type of image G to be fixed greatly differs with each device, a reflecting member that suits its corresponding device may be used as the reflecting member 2.

From the viewpoint of further increasing fixing efficiency using the illuminating units 1, it is desirable to further provide a back-side reflecting member that is provided at a back-side portion that opposes the reflecting member 2 with the recording medium P being disposed therebetween, and that reflects again transmitted light, transmitted through the recording medium P, of the laser light Li, applied from the illuminating units 1, towards the recording medium P. As with the above-described reflecting member 2, such a back-side reflecting member may include protruding reflecting surfaces 3. Since the transmitted light, transmitted through the recording medium P, is widely scattered, the back-side reflecting member may be any member as long as it reflects such transmitted light towards the recording medium P. In accordance with the wide scattering of the transmitted light, the probability with which the transmitted light strikes the back side of the image G on the recording medium P is increased.

Further, from the viewpoint of efficiently using the reflected light Lr at the illumination area IR where the image does not exist, it is desirable for the illuminating units 1 to apply the laser light Li to the illumination area IR that is inclined with respect to a predetermined image-G disposition reference direction along the widthwise direction of the recording medium P crossing the direction of movement of the recording medium P.

Ordinarily, the image G, including, for example, ruled lines and character strings, on the recording medium P is such that the ruled lines and character strings are often consecutively provided in a row that is orthogonal to the direction of movement of the recording medium P and in a row that is parallel to the direction of movement of the recording medium P. Therefore, if the illumination area IR is disposed in a direction orthogonal to the direction of movement of the recording medium P (that is, in the widthwise direction of the recording medium P), it is assumed that portions having high image densities are continuously provided along the longitudinal direction of the illumination area IR. In such a case, if the illumination area IR is inclined with respect to the widthwise direction of the recording medium P, a large number of portions where the image does not exist appear in the illumination area IR, so that the reflected light Lr from the illumination area IR is more efficiently used.

From the viewpoint of reducing the illumination intensity at each illuminating unit 1, it is desirable for the heating device to further include an acquiring unit that acquires image information of the image G formed on the recording medium P, the image G being fixable by heating; a calculating unit that calculates image density of an image area corresponding to the illumination area IR from the image information acquired at the acquiring unit; a detecting unit that detects a timing at which the image area whose image density is calculated at the calculating unit reaches the illumination area IR; and an output controller that controls illumination output of each illuminating unit 1 so that the illumination output of each illuminating unit 1 is less than an output for when the image density calculated at the calculating unit exceeds a predetermined reference value, when the image density of the image area corresponding to the illumination area IR calculated at the calculating unit is less than or equal to the predetermined reference value and when the timing is detected at the detecting unit.

To apply such a heating device to an image forming apparatus, the image forming apparatus includes a transporting unit that transports the recording medium P, an image forming unit that forms the image G that is fixable to the recording medium P by heating, and a heating device that fixes the image G formed on the recording medium P at the image forming unit, with the above-described heating device according to the exemplary embodiment being used as the heating device. Further, a more desirable exemplary embodiment of such an image forming apparatus is an exemplary embodiment using a recording medium P that is continuous in a direction of transportation of the recording medium P.

Next, the present invention will be described in more detail on the basis of illustrated exemplary embodiments shown in the drawings.

First Exemplary Embodiment

Figure 2:
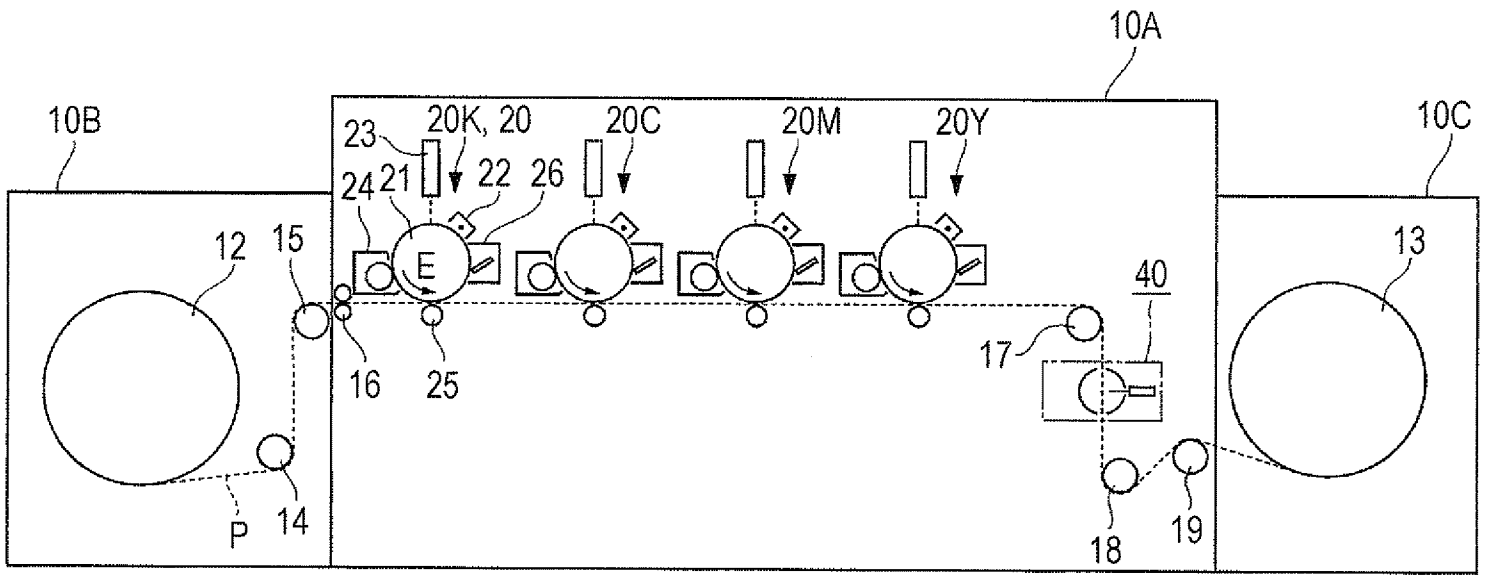
FIG. 2 schematically illustrates an image forming apparatus according to a first exemplary embodiment.

FIG. 2 schematically illustrates an image forming apparatus according to a first exemplary embodiment to which the heating device according to the model of the above-described exemplary embodiment is applied.

The image forming apparatus according to the exemplary embodiment is formed so as to use a continuous recording medium P. The image forming apparatus according to the exemplary embodiment includes an image forming apparatus body 10A that forms an image on the recording medium P, a supplying device 10B that supplies the recording medium P lies upstream of the image forming apparatus body 10A in a direction of transportation of the recording paper P, and a holding device 10C that holds the recording medium P on which the image is formed lies downstream of the image forming apparatus body 10A in a direction of transportation of the recording paper P. The recording medium P may be a sheet roll or may be a continuous sheet that is folded. In the exemplary embodiment, the image forming apparatus using a sheet roll will be described.

The image forming apparatus body 10A according to the exemplary embodiment is, for example, an electrophotographic type. The image forming apparatus body 10A includes, for example, image forming units 20 for respective colors (more specifically, a black image forming unit 20K, a cyan image forming unit 20C, a magenta image forming unit 20M, and a yellow image forming unit 20Y), a heating device 40, and roller members 16 to 19. The image forming units 20 form images of the respective colors on the recording medium P using, for example, toners of multiple colors. The heating device 40 fixes the images formed in a superimposed state on the recording medium P at the image forming units 20 for the respective colors. The roller members 16 to 19 are provided, respectively, at multiple locations of a path along which the recording medium P is transported.

Here, the roller members 16 are position adjusting rollers that adjust the position of the recording medium P that is guided towards the image forming units 20 of the image forming apparatus body 10A. The roller member 17 is a tightly stretching roller that guides the recording medium P towards the heating device 40. The roller members 18 and 19 are tension applying rollers that apply a predetermined tension to the recording medium P when the recording medium P to which the images are fixed is transported towards the holding device 10C.

Since the image forming units 20 for the respective colors, which differ in that they use different toners, have substantially the same structure, the image forming units 20 will be described using the black image forming unit 20K as a typical example. The black image forming unit 20K (20) includes a cylindrical photoconductor member 21 that has a photosensitive layer (not shown) on its surface, and that rotates in the direction of arrow E. A charging device 22, an exposure device 23, a developing device 24, a transfer device 25, a cleaning device 26, etc. are disposed around the photoconductor member 21. The charging device 22 charges the photosensitive layer of the photoconductor member 21 to a predetermined potential. Using, for example, laser light, the exposure device 23 selectively illuminates the photosensitive layer charged by the charging device 22, and forms an electrostatic latent image on the photoconductor member 21. The developing device 24 develops the electrostatic latent image formed by the exposure device 23 using toner to make visible the electrostatic latent image. The transfer device 25 transfers the image on the photoconductor member 21 to the recording medium P. The cleaning device 26 cleans off any residual toner on the photoconductor member 21 after the transfer. The arrangement of the toner colors of the image forming units 20 are not limited to that mentioned above. Therefore, it goes without saying that other arrangements of the toner colors may be used.

The supplying device 10B includes, for example, a supply roller 12 and tension applying rollers 14 and 15. The supply roller 12 holds the recording medium P wound in a roll around a core. The tension applying rollers 14 and 15 apply tension to the recording medium P while transporting the recording medium P to supply it to the image forming apparatus body 10A. The holding device 10C includes, for example, a take-up roller 13 that takes up and holds the recording medium P around the core.

In such an image forming apparatus, the images of the respective colors are successively transferred from the image forming units 20 for the respective colors of the image forming apparatus body 10A to the recording medium P supplied from the supplying device 10B, and are multiplexed on the recording medium P. After the heating device 40 fixes the multiplexed unfixed images to the recording medium P on which the multiplexed unfixed images are formed, the recording medium P is taken up and held by the holding device 10C.

Next, the heating device 40 of such an image forming apparatus will be described.

Figure 3:
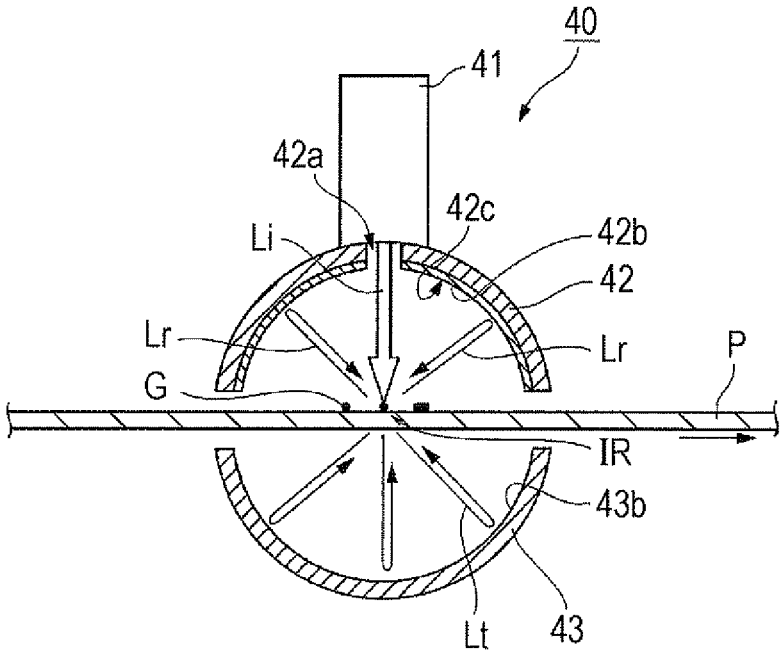
FIG. 3 schematically illustrates a heating device according to the first exemplary embodiment.

As shown in FIG. 3, the heating device 40 according to the exemplary embodiment includes an array laser 41 serving as an illuminating unit, a reflecting member 42, and a back-side reflecting member 43. The array laser 41 illuminates a strip-like illumination area IR with laser light Li. The illumination area IR is provided in correspondence with a recording medium P on which an image G which is fixable by heating is formed, and is formed at a predetermined position on the recording medium P along a widthwise direction of the recording medium P crossing a direction of transportation of the recording medium P. The reflecting member 42 is provided so as to surround the illumination area IR, and reflects again reflected light Lr coming from the illumination area IR towards the recording medium P. The back-side reflecting member 43 is provided at a back-side portion that opposes the reflecting member 42 with the recording medium P being disposed therebetween, and that reflects again transmitted lights Lt, transmitted through the recording medium P, of the laser light Li, applied from the array laser 41, towards the recording medium P.

In the array laser 41 according to the exemplary embodiment, multiple high-output semiconductor lasers are disposed side by side along a longitudinal direction of the illumination area IR (corresponding to the widthwise direction of the recording medium P). The array laser 41 includes, for example, an optical system that converges laser lights Li on the illumination area IR on the recording medium P. In the illumination area IR, the laser lights Li from adjacent high-output semiconductor lasers overlap each other at their end portions, so that the illumination intensities of the laser lights Li in the illumination area IR are set so as to be substantially equal to each other, and so that the lengths of image formation areas in the widthwise direction of the recording medium P are capable of being illuminated. It is possible to form multiple high-output semiconductor lasers using a high-powered semiconductor laser array.

The reflecting member 42 has an elongated opening 42*a* formed in a central portion of a substantially half cylinder so as to allow the laser lights Li to be applied from the array laser 41 towards the illumination area IR. The reflecting member 42 may have an integrated structure, or it may be divided at, for example, the opening 42*a* serving as a boundary. The array laser 41 may also be formed on the basis of a layout in which the array laser 41 is separated from the opening 42*a*.

In contrast, the back-side reflecting member 43 according to the exemplary embodiment does not have an opening that corresponds to the opening 42*a* of the reflecting member 42, and is such that the transmitted lights Lt from the illumination area IR are reflected to a back portion of the recording medium P.

The reflecting member 42 according to the exemplary embodiment has protruding reflecting surfaces 42*c* which are curved in cross section, which protrude towards the recording medium P with respect to a widthwise direction of the illumination area IR (corresponding to the direction of transportation of the recording medium P), and which are consecutively provided. The protruding reflecting surfaces 42*c* are continuously provided towards the longitudinal direction of the illumination area IR (corresponding to the widthwise direction of the recording medium P). The protruding reflecting surfaces 42*c* become reflecting surfaces 42*b*. That is, whereas the reflecting surfaces 42*b* are substantially semicircular around the illumination area IR with respect to the widthwise direction of the illumination area IR, the reflecting surfaces 42*b* are such that the protruding reflecting surfaces 42*c* are continuously formed in the longitudinal direction of the illumination area IR. The cross-sectional shapes of the protruding reflecting surfaces 42*c* are curved surfaces extending towards the illumination area IR.

In the exemplary embodiment, unlike the reflecting member 42, a reflecting surface 43*b* of the back-side reflecting member 43 does not have portions that correspond to the protruding reflecting surfaces 42*c* of the reflecting member 42. The reflecting surface 43*b* has a substantially semicircular shape with respect to the widthwise direction of the illumination area IR. It goes without saying that the reflecting surface 43*b* of the back-side reflecting member 43 may be formed like the reflecting surfaces 42*b* of the reflecting member 42.

Next, actions at the reflecting surfaces 42*b* of the reflecting member 42 will be described.

Figure 4A:
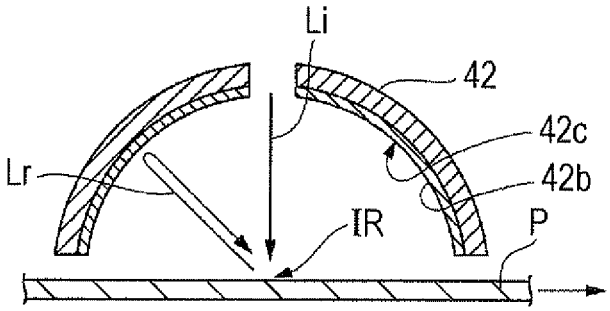
FIGS. 4A and 4B illustrate actions at reflecting surfaces of a reflecting member, with FIG. 4A being a sectional view of the reflecting member as seen in a direction along a longitudinal direction of an illumination area, and FIG. 4B being an enlarged sectional view of a principal portion of the reflecting member as seen along the direction of the widthwise direction of the illumination area.
Figure 4B:
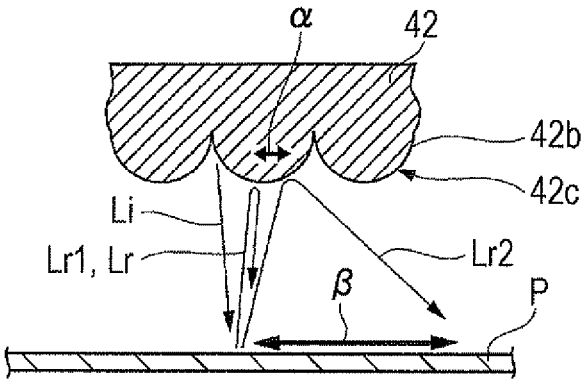

FIG. 4A is a sectional view of the reflecting member 42 as seen in a direction along the longitudinal direction of the illumination area IR. The reflecting surfaces 42*b* of the reflecting member 42 have the multiple protruding reflecting surfaces 42*c*. All of the reflecting surfaces 42*b* are formed at these protruding reflecting surfaces 42*c*. FIG. 4B is an enlarged sectional view of a principal portion of the reflecting member 42 as seen in a direction along the widthwise direction of the illumination area IR, and shows that the reflecting surfaces 42*b* are formed at the multiple continuously formed protruding reflecting surfaces 42*c*. In addition, such protruding reflecting surfaces 42*c* have changing surfaces.

First, as shown in FIG. 4A, when the reflecting member 42 is seen in a direction along the longitudinal direction of the illumination area IR, the reflected light Lr of the laser light Li that has been applied to the illumination area IR becomes scattered light that is scattered in all directions. However, since the reflecting surfaces 42*b* of the reflecting member 42 are substantially semicircular with respect to the widthwise direction of the illumination area IR, the reflected light Lr that has been reflected radially from the illumination area IR converges again at the illumination area IR.

On the other hand, as shown in FIG. 4B, when the reflecting member 42 is seen along a direction of the widthwise direction of the illumination area IR, since the reflecting surfaces 42*b* of the reflecting member 42 are such that the curved protruding reflecting surfaces 42*c* are provided continuously in the longitudinal direction of the illumination area IR, a reflected light Lr of the laser lights Li spread in the longitudinal direction of the illumination area IR (which is not shown in FIG. 4B because the longitudinal direction is a direction along a surface of the recording medium P).

Focusing on two reflected lights Lr1 and Lr2 serving as reflected lights Lr from the illumination area IR, when the two reflected lights Lr1 and Lr2 reach the protruding reflecting surface 42*c* of the reflecting member 42, an area in the widthwise direction of the recording medium P is $\alpha$, whereas, after they are reflected at the protruding reflecting surface 42*c*, the area is widened to an area indicated by $\beta$ in FIG. 4B on the recording medium P. That is, the protruding reflecting surface 42*c* of the reflecting member 42 according to the exemplary embodiment reflects the reflected lights Lr coming from the illumination area IR so as to spread in the longitudinal direction of the illumination area IR (corresponding to the widthwise direction of the recording medium P).

Although, ordinarily, the laser lights Li that are applied to the illumination area IR are spread and reflected in all directions, components of the reflected lights Lr having high illumination intensities are reflected at small angles from the illumination area IR. Therefore, how effectively the components of the reflected lights Lr having such small reflection angles are caused to travel towards the illumination area IR becomes relevant to actions at the reflection surfaces 42*b*. In the exemplary embodiment, by providing the protruding reflecting surfaces 42*c*, the components of the reflected lights Lr having high intensities and reflected from the illumination area IR are spread in different directions in the longitudinal direction of the illumination area IR without returning to reflection positions of the reflected lights Lr.

That is, as shown in FIG. 4B, a light beam of each reflected light Lr that has a high intensity and that spreads in, for example, the area α is capable of being spread to the area β on the recording medium P. As a result, even if there is a portion having a different image density in the illumination area IR, when a portion of each reflected light Lr coming from a surface of the recording medium P corresponding to a low-image-density portion where an image primarily does not exist is spread by the reflecting member 42 in the longitudinal direction of the illumination area IR, an effective light quantity at a high-image-density portion is increased. Therefore, the images are properly fixed along the entire illumination area IR.

Next, the relationship between actions at the reflecting surfaces 42*b* of the reflecting member 42 and images will be described.

Figure 5A:
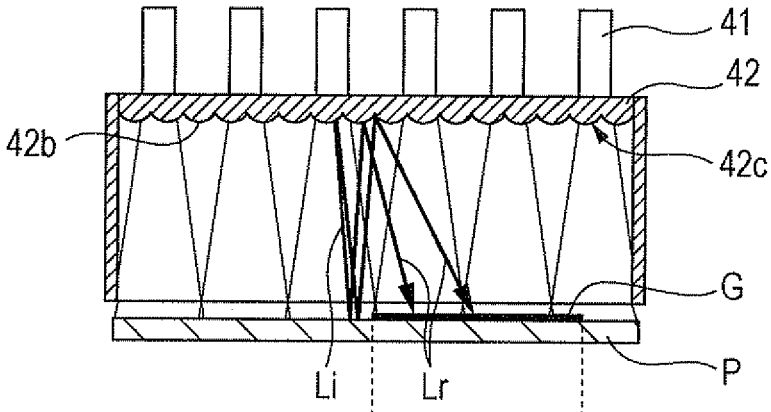
FIGS. 5A to 5C show actions at the reflecting member according to the first exemplary embodiment, with FIG. 5A being a sectional schematic view of the reflecting member, FIG. 5B illustrating the relationship between an image and light quantity, and FIG. 5C illustrating an image on a recording medium.

FIG. 5A is a sectional schematic view of the reflecting member 42 according to the exemplary embodiment as seen in a direction along the widthwise direction of the recording medium P. The reflecting surfaces 42*b* of the reflecting member 42 are such that multiple protruding reflecting surfaces 42*c* are continuously provided along the widthwise direction of the recording medium P. The protruding reflecting surfaces 42*c* are provided along the entire reflecting member 42 in the direction of transportation of the recording medium P.

Figure 5B:
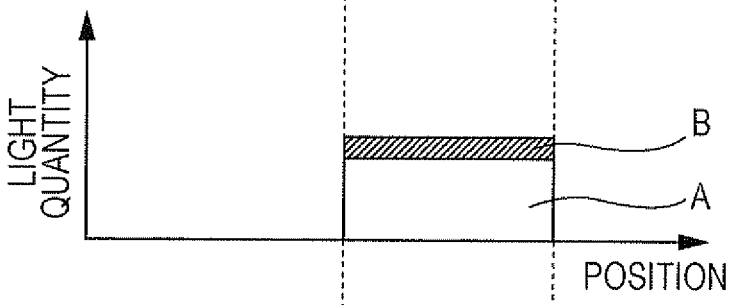
Figure 5C:
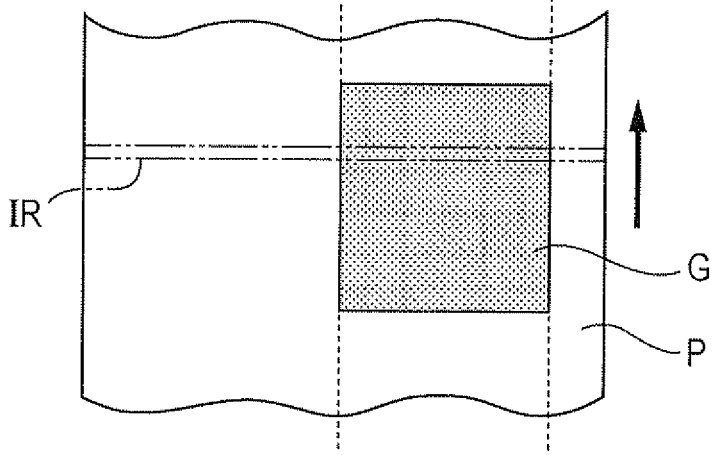

A description will be given taking as an example the case in which a wide unfixed image G (solid image) is formed on a portion of the recording medium P in the widthwise direction. FIG. 5B shows light quantity that is received by the image G of the laser lights Li applied from the array laser 41. FIG. 5C illustrates the recording medium P as seen from above the recording medium P (that is, as seen from the array laser 41). For example, a portion indicated by alternate long and two short dash lines in FIG. 5C corresponds to the illumination area IR that is illuminated by the array laser 41.

In this case, a large portion of each laser light Li that has been applied to the illumination area IR is absorbed by the image G at a portion where the image G exists (corresponding to a portion A in FIG. 5B), so that the temperature of the image G is increased. In contrast, at a portion where the image G does not exist at the illumination area IR, a large portion of each laser light Li becomes the reflected light Lr reflected from a surface of the recording medium P. When the reflected light Lr strikes each protruding reflecting surface 42*c* of the reflecting member 42, the reflected light Lr is considerably spread in the longitudinal direction of the illumination area IR, that is, in the widthwise direction of the recording medium P in the exemplary embodiment.

In general, each reflected light Lr from the recording medium P is such that, the smaller its angle of reflection from the illumination area IR, the higher its intensity. Therefore, the intensities of portions of the reflected lights Lr that are reflected at portions close to the applied laser lights Li become high.

In the exemplary embodiment, by providing the protruding reflecting surfaces 42*c*, the portions of the reflected lights Lr that are reflected at the portions close to the laser lights Li and whose intensities are high are spread in the longitudinal direction of the illumination area IR by the changing surfaces of the protruding reflecting surfaces 42*c*. Therefore, as shown in, for example, FIG. 5A, the high-intensity portions of the reflected lights Lr strike a wide area of the image G.

Not only at portions that are close to the image G, but also at portions that are far away from the image G, the portions of the reflected lights Lr having small reflection angles from the illumination area IR also spread along the image G that is far away. Therefore, the light quantity received by the image is further equalized.

As a result, the light quantity received by the image G includes a substantially equalized portion B shown in FIG. 5B. Even if the image G is a solid image, the temperature rise of the image G along the longitudinal direction of the illumination area IR is equalized. Therefore, the entire image G is stably fixed. In the exemplary embodiment, it goes without saying that, even if the image G is, for example, a dot image, the dot image G is similarly fixed.

Next, for comparison, a case in which a reflecting member 42' includes reflecting surfaces 42*b'* that are not provided with protruding reflecting surfaces 42*c*, that is, a case in which the cross-sectional shape of each reflecting surface 42*b'* is a linear shape that is parallel to a surface of the recording medium P when seen in a direction along the widthwise direction of the recording medium P will be described.

Figure 6A:
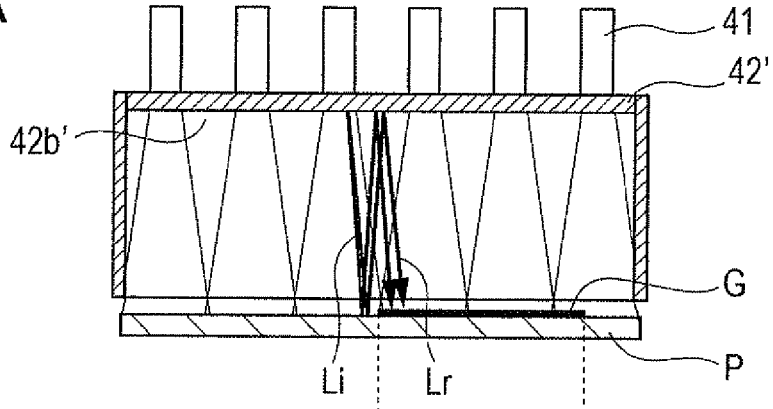
FIGS. 6A to 6C show actions at a reflecting member according to a comparative example, with FIG. 6A being a sectional schematic view of the reflecting member, FIG. 6B illustrating the relationship between an image and light quantity, and FIG. 6C illustrating an image on a recording medium.
Figure 6B:
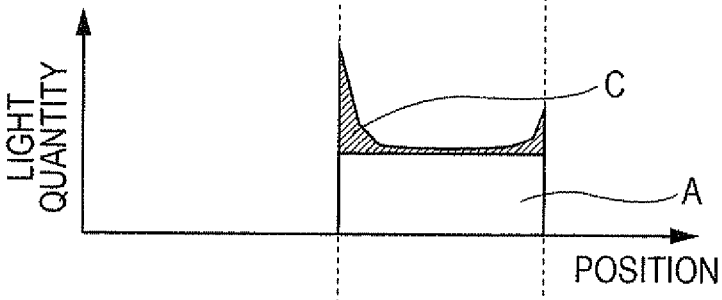
Figure 6C:
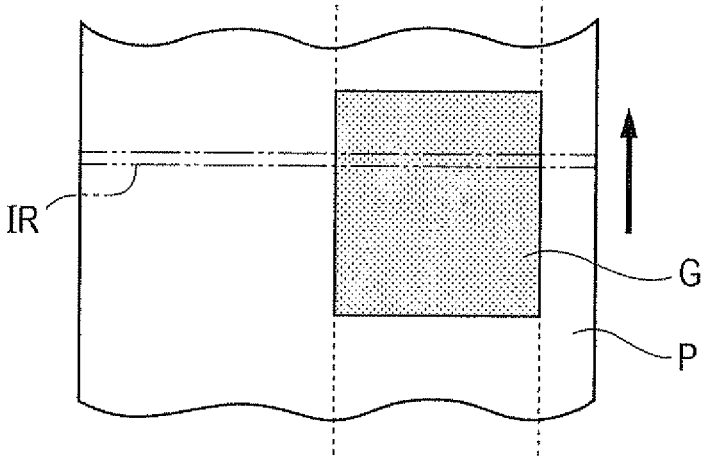

FIG. 6A is a sectional schematic view of the reflecting member 42' as seen in a direction along the widthwise direction of the recording medium P. FIG. 6B illustrates light quantity received by the image G using the laser lights Li emitted from the array laser 41. FIG. 6C illustrates a recording medium P as seen from above the recording medium P (that is, as seen from the array laser 41).

In this case, a large portion of each laser light Li that has been applied to the illumination area IR is absorbed by the image G at a portion where the image G exists (corresponding to a portion A in FIG. 6B), so that the temperature of the image G is increased. This portion is similar to that shown in FIG. 5B.

At a portion where the image G does not exist at the illumination area IR, a large portion of each laser light Li becomes reflected light Lr reflected from a surface of the recording medium P. The reflected lights Lr are reflected by the reflecting surfaces 42*b'*, and travel towards the illumination area IR. Portions of the reflected lights Lr coming from portions close to the image G are simply reflected by the reflecting surfaces 42*b'* of the reflecting member 42'. Therefore, the components of the reflected lights Lr having high intensities and reflected by the image G concentrate near the image G. That is, the components of the reflected lights Lr having small reflection angles and existing near the image G are simply reflected by the reflecting surfaces 42*b'*, to strike the image G. The striking locations are concentrated at end portions of the image G. There are portions of the reflected lights Lr that strike the image G and that have large angles of reflection from locations that are far way from the image G. Since the reflection angles are large, the intensities are low, as a result of which these portions of the reflected lights Lr virtually do not contribute to the fixing of the image G. Therefore, the reflected lights Lr that cause the temperature of the image G to increase are reflected lights Lr reflected from locations near the image G, and concentrate at end portions of the image G. Consequently, it becomes difficult for the light quantity to become equalized by spreading the reflected lights Lr along the entire image G.

As a result, as shown in FIG. 68, the light quantity received by the image G includes light quantity (a portion C in FIG. 6B) added to a portion A in FIG. 6B. The portion A is directly illuminated with the laser lights Li. The light quantity corresponding to the portion C is a quantity that is increased near end portions of the image G. That is, a light quantity distribution at the image G along the widthwise direction of the recording medium P is large near the end portions of the image G, whereas it is small near the center of the image G. As the width of the image G increases, the distribution is considerably tilted.

Therefore, in order to fix the entire image G, it is necessary to sufficiently heat portions of the image G near the center thereof having a small light quantity distribution. Consequently, the illumination intensities of the laser lights Li need to be increased.

In such a case, scattering of toner or generation of smoke caused by excessive light quantity or excessive illumination light quantity may occur at the end portions of the image G. When the illumination intensity of each laser light Li is reduced in order to prevent the scattering of toner or the generation of smoke from occurring, the fixability of the entire image G may be reduced. Even in such a comparison, when the image G is, for example, a dot image, it goes without saying that fixing that is similar to that according to the exemplary embodiment is performed.

Such a trend is further noticeable in heating devices using recording media P having highly smooth surfaces, such as films and coated paper.

In the exemplary embodiment, by providing the reflecting member 42 with the protruding reflecting surfaces 42*c*, the components of the reflected lights Lr having high intensities and reflected from the recording medium P spread over a wide width in the longitudinal direction of the illumination area IR, so that the light quantity is becoming equalized over the entire image G. Accordingly, even if the illumination intensity of the laser light Li, itself, is not made that high, the images are adequately fixed.

Although, in the exemplary embodiment, the reflecting surfaces 42*b* are such that the curved protruding reflecting surfaces 42*c* are continuously provided, the reflecting surfaces 42*b* are not limited thereto. The reflecting surfaces 42*b* may be any reflecting surfaces as long as they have portions that spread the reflected lights Lr along the longitudinal direction of the illumination area IR. For example, the reflecting surfaces 42*b* may have the following forms.

Figure 7A:
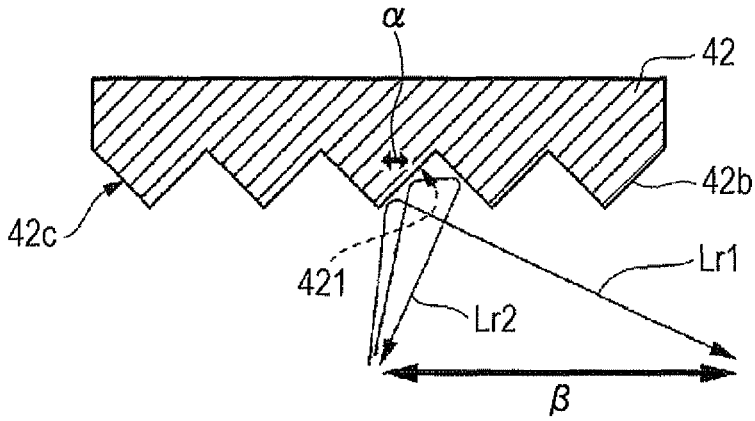
FIGS. 7A to 7C illustrate modifications of the reflecting surfaces of the reflecting member.
Figure 7B:
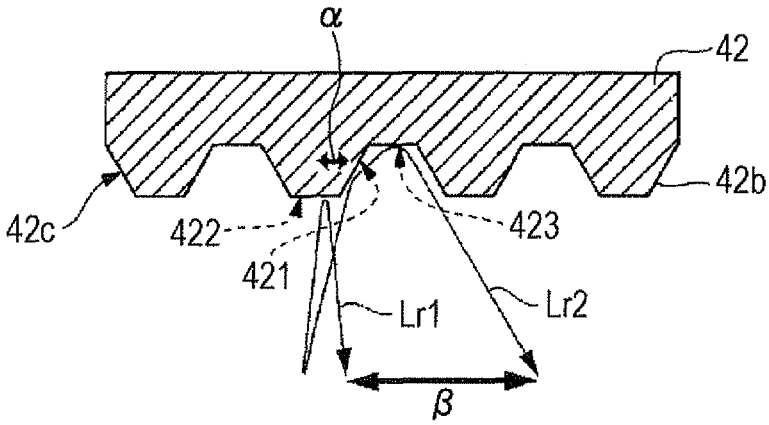
Figure 7C:
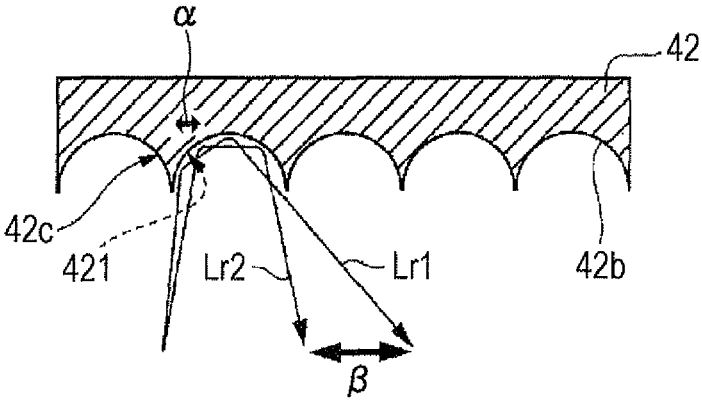

FIGS. 7A to 7C show modifications of the reflecting surfaces 42*b* of the reflecting member 42. The reflecting surfaces 42*b* shown in FIG. 7A are such that substantially triangular protruding reflecting surfaces 42*c* are formed continuously towards the longitudinal direction of the illumination area IR (not shown). The reflecting surfaces 42*b* shown in FIG. 7B are such that trapezoidal protruding reflecting surfaces 42*c* are discretely disposed towards the longitudinal direction of the illumination area IR. The reflecting surfaces 42*b* shown in FIG. 7C are such that curved recesses are formed continuously towards the longitudinal direction of the illumination area IR, with the protruding reflecting surfaces 42*c* being formed between adjacent recesses.

That is, in FIG. 7A, both surfaces of a triangular portion of each triangular protruding reflecting surface 42*c* are formed as an inclined changing surface 421. In FIG. 7B, inclined portions of the trapezoidal protruding reflecting surfaces 42*c* are formed as changing surfaces 421. In addition, flat surfaces 422 (surfaces that are substantially parallel to a surface of a recording medium) are provided at portions of the protruding reflecting surfaces 42*c*, and connecting surfaces 423 are provided between the adjacent protruding reflecting surfaces 42*c*. In FIG. 7C, both surfaces of each protruding reflecting surface 42*c* are formed as changing surfaces 421.

In the case shown in FIG. 7A, if reflected lights Lr1 and Lr2 having high intensities are considered, the reflected lights Lr1 and Lr2 are reflected by the changing surfaces 421 of the protruding reflecting surfaces 42*c*, and are spread as shown in FIG. 7A. Therefore, when a light beam between the reflected lights Lr1 and Lr2 is considered, this light beam is scattered to a wide area β at the illumination area IR (not shown) that is wider than an area a where the reflected lights Lr1 and Lr2 are reflected at the reflecting surface 42*b*.

In the case shown in FIG. 7B, reflected lights Lr1 and Lr2 having high intensities are reflected by the changing surface 421 and the flat surface 422 of the protruding reflecting surface 42*c*. In particular, since the reflected light Lr2 reflected at the changing surface 421 is reflected so as to be considerably spread, the reflected light Lr2 becomes a light beam that is scattered to a wide area β at the illumination area IR that is wider than an area α where the reflected lights Lr1 and Lr2 are reflected at the reflecting surface 42*b*. Although it is not possible to expect the connecting surfaces 423, themselves, to act so as to directly spread the portions of the reflected lights Lr having high intensities to large distances, the connecting surfaces 421 are capable of helping the changing surfaces 421 of the protruding reflecting surfaces 42*c* to reflect the reflected light Lr1 and to spread the reflected light Lr1 to large distances. In addition, the connecting surfaces 423 cause high-intensity portions of the reflected lights Lr to be provided with respect to portions of the illumination area IR corresponding to portions that are close-by.

Further, in the case shown in FIG. 7C, reflected lights Lr1 and Lr2 having high intensities are reflected by the changing surface 421 (which is a curved recess in FIG. 7C) and are spread as illustrated. For this reason, when a light beam between the reflected lights Lr1 and Lr2 is considered, this light beam is scattered to a wide area β at the illumination area IR (not shown) that is wider than an area α where the reflected lights Lr1 and Lr2 are reflected at the reflecting surface 42*b*.

As long as each reflecting surface 42*b* is provided with such a protruding reflecting surface 42*c*, and a changing surface 421 is provided at at least a portion of the protruding reflecting surface 42*c*, when a high-intensity portion of each reflected light Lr from a portion where the image does not exist is reflected by any of the changing surfaces 421, each reflected light Lr reflected from the reflecting surface 42*b* is scattered in the longitudinal direction of the illumination area IR. Therefore, a light quantity thereof is added to the portion where the image exists accordingly. Accordingly, the shapes of the protruding reflecting surfaces 42*c* of the reflecting member 42 only need to allow the reflected lights Lr (having small reflection angles) from the recording medium P to be scattered in the longitudinal direction of the illumination area IR. However, in order to effectively spread the reflected lights Lr coming from the illumination area IR, it is desirable to continuously provide the protruding reflecting surfaces 42*c* in the longitudinal direction of the illumination area IR from the viewpoint of scattering the reflected light Lr more widely.

The shapes of the protruding reflecting surfaces 42*c* are not limited to those mentioned above. Each protruding reflecting surface 42*c* may be formed so as to include a changing surface 421 that scatters the reflected lights Lr having high intensities and coming from the illumination area IR along the longitudinal direction of the illumination area IR. It goes without saying that the shapes of the reflecting member 42 may also be similarly applied to the back-side reflecting member 43.

Figure 8:
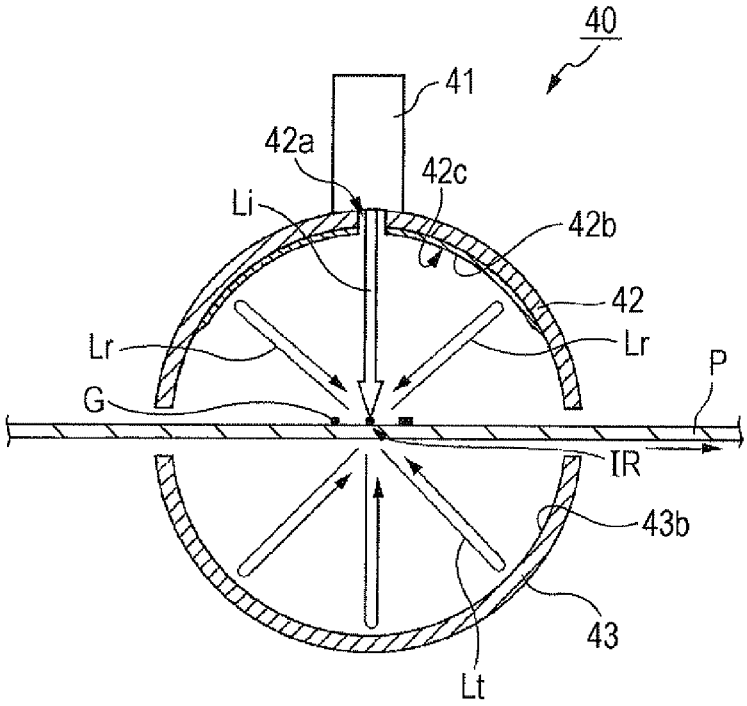
FIG. 8 shows a modification of the reflecting member.

Further, the protruding reflecting surfaces 42*c* of the reflecting member 42 need not be provided along the entire area of the reflecting surfaces 42*b* of the reflecting member 42 along the widthwise direction of the illumination area IR. FIG. 8 shows the heating device 40 including a reflecting member 42 according to a modification of the exemplary embodiment. In this case, the protruding reflecting surfaces 42*c* are not provided at portions of the reflecting surfaces 42*b* of the reflecting member 42 near the recording medium P. In such a structure, high-intensity portions of the reflected lights Lr provided by applying the laser light Li from the array laser 41 and reflected from the illumination area IR concentrate near the laser light Li in FIG. 8. That is, the reflected lights Lr to be scattered by any of the projecting reflecting surfaces 42*c* in the longitudinal direction of the illumination area IR are close to the laser light Li. By scattering such reflected lights Lr, similar effects to those that are provided when the protruding reflecting surfaces 42*c* are provided along the entire areas are provided.

Figure 9:
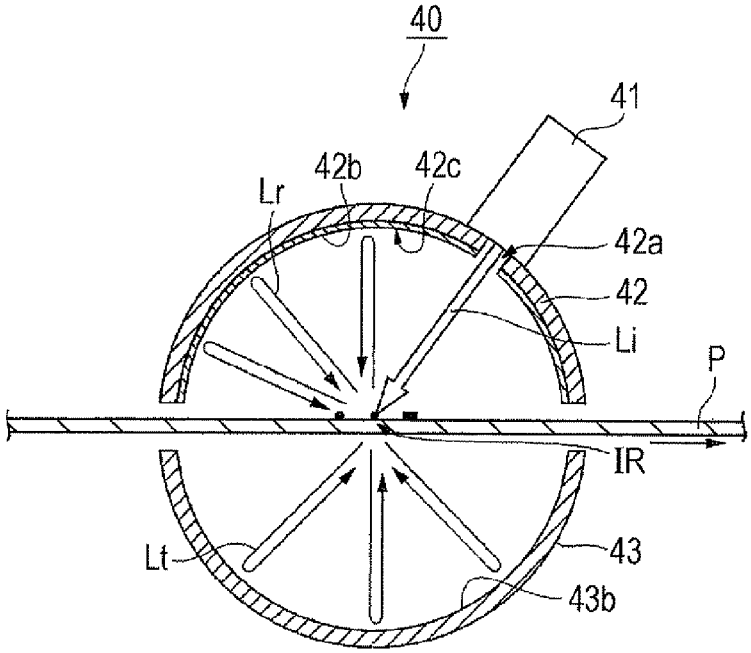
FIG. 9 schematically illustrates a first modification of the heating device according to the first exemplary embodiment.

FIG. 9 illustrates a first modification of the heating device 40 according to the exemplary embodiment. A heating device 40 according to the modification differs from the heating device 40 shown in FIG. 3 in that the position of the opening 42*a* of the reflecting member 42 differs. In the modification, the opening 42*a* of the reflecting member 42 is provided so as to be inclined downstream from the illumination area IR in the direction of transportation of the recording medium P.

When the opening 42*a* is disposed thus, a large portion of each reflecting light Lr that is provided by the laser light applied from the array laser 41 and that comes from the illumination area IR is reflected upstream from the opening 42*a* of the reflecting member 42 in the direction of transportation of the recording medium P. Since wide reflecting surfaces 42*b* of the reflecting member 42 are provided at the reflection points, the reflected lights Lr from the illumination area IR are more easily reflected towards the illumination area IR. At a side of the back-side reflecting member 43, since transmitted lights Lt are not distributed as much as the reflected lights Lr at a side of the reflecting member 42, the distribution of the transmitted lights is not influenced by the position of the opening 42*a* of the reflecting member 42 very much.

Further, although, in the above-described exemplary embodiment, one illumination area IR is used, for example, a multiple number of array lasers 41 may be provided in the direction of transportation of the recording medium P.

Figure 10:
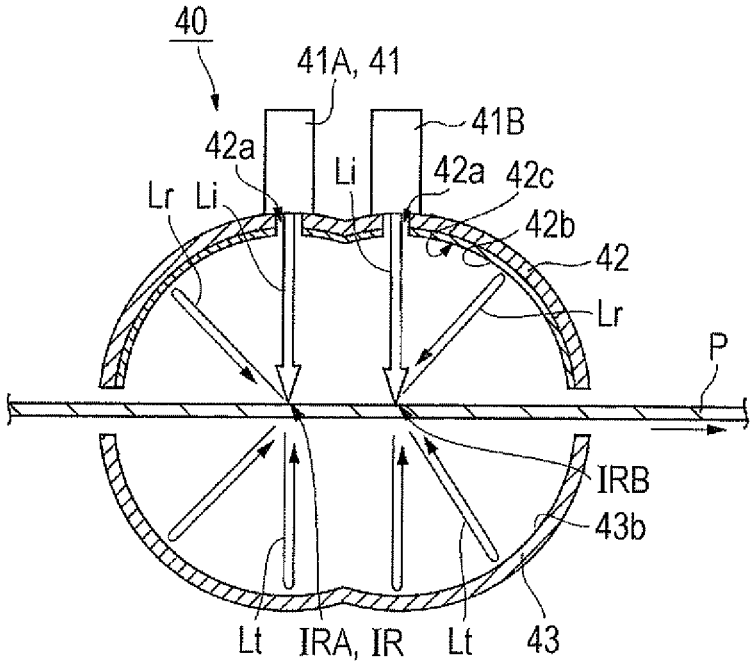
FIG. 10 schematically illustrates a second modification of the heating device according to the first exemplary embodiment.

FIG. 10 illustrates a second modification of the heating device 40 according to the exemplary embodiment. In the second modification, one reflecting member 42 has two openings 42*a* along the direction of transportation of the recording medium P. In addition, laser lights Li are emitted from two array lasers 41 (41A and 41B) from these openings 42*a*, so that two illumination areas IR (IRA and IRB) are formed.

The reflecting member 42 includes two substantially semicircular cylindrical members that are connected to each other. Each reflecting surface 42*b* is provided with a protruding reflecting surface 42*c*. A back-side reflecting member 43 includes two substantially semicircular cylindrical members that are connected to each other. The back-side reflecting member 43 is not provided with a surface that corresponds to each protruding reflecting surface 42*c* of the reflecting member 42.

In such a structure, first, the laser light Li from the upstream-side array laser 41A is applied to an image on the recording medium P at the illumination area IRA. After passage of a certain time, the laser light Li from the downstream-side array laser 41B is applied to an image on the recording medium P at the illumination area IRB.

When the image is illuminated thus, a portion at the recording medium P where image density is high (such as a solid image portion) is such that its interface temperature between toner and the recording medium P is slightly increased at the upstream-side illumination area IRA. Thereafter, at portions that are not illuminated, the interface temperature is gradually reduced. However, since the image density is high and surface area is small, heat-dissipation amount is small, so that the amount of temperature reduction is small.

Next, by heating the image at the downstream-side illumination area IRB once again, the interface temperature is also sufficiently increased, so that adequate adhesion is ensured.

At a portion at the recording medium P where the image density is low (such as a high-lighted image portion), the interface temperature is sufficiently increased once, and is, then, reduced suddenly. When the image is heated once again at the downstream-side illumination area IRB, the temperature of the interface temperature is increased once again. That is, whereas the interface temperature is ensured by two illuminations at the portion where the image density is high, the interface temperature is ensured by one illumination at the portion where the image density is low, and these are repeated.

Therefore, sufficient adhesion with respect to the recording medium P is ensured in both cases regardless of the image density at the recording medium P.

When there are two such illumination areas IR, the following may be performed.

When laser output at the upstream-side illumination area IRA is set smaller than laser output at the downstream-side illumination area IRB, and the width of the illumination area IRA is made accordingly large along the direction of transportation of the recording medium P, illumination time at the upstream-side illumination area IRA is made long. It goes without saying that, at this time, in accordance with the portion having a high image density, the width of the illumination area IRA and illumination intensity are such as to allow the image to be sufficiently heated and fused at the upstream-side illumination area IRA.

When the image is illuminated thus, adequate adhesion is ensured at the portion where the image density is high at the upstream-side illumination area IRA, so that problems do not occur even when the illumination time at the downstream-side illumination area IRS is short. In contrast, at the portion where the image density is low, in the illumination at the upstream-side illumination area IRA, since contact area between toner particles and outside air is wide, the heating and fusion of the toner may become insufficient due to an increase in the heat-dissipation amount. However, since the illumination intensity at the downstream-side illumination area IRB is increased, the toner is sufficiently fused, so that adequate adhesion is ensured. That is, the toner is sufficiently heated and fused regardless of the image density at the recording medium P. Even in such a mode, it goes without saying that the reflected lights Lr from the reflecting member 42 and the transmitted lights Lt from the back-side reflecting member 43 are widely used, so that fixing efficiency is increased.

Second Exemplary Embodiment

Figure 11:
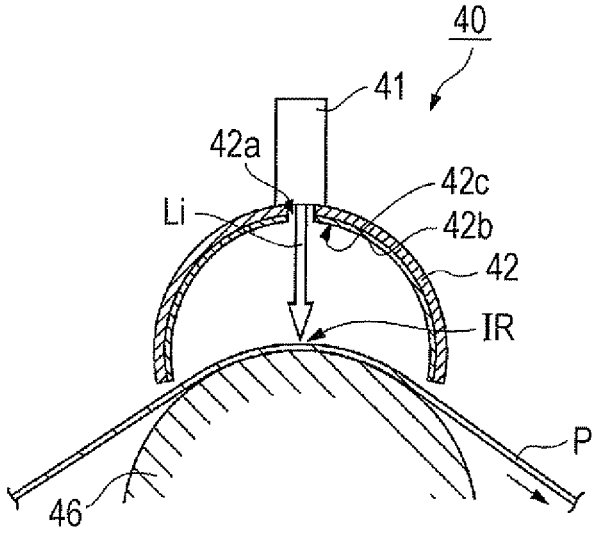
FIG. 11 schematically illustrates a heating device according to a second exemplary embodiment.

FIG. 11 schematically illustrates a heating device 40 according to a second exemplary embodiment.

The heating device 40 according to the exemplary embodiment differs from the heating device 40 according to the first exemplary embodiment (see, for example, FIG. 3) in that it does not include a back-side reflecting member. Structural elements that correspond to those according to the first exemplary embodiment are given the same reference numerals, and will not be described in detail here.

In FIG. 11, an opposing member 46 is disposed at a position opposing a reflecting member 42 with a recording medium P being disposed therebetween. The opposing member 46 holds the recording medium P at a side of an array laser 41. The opposing member 46 is a heat-resistant round bar that is white and round. For example, the surface of the opposing member 46 is subjected to low-friction processing using, for example, fluorocarbon resin. An axial direction of the opposing member 46 is disposed in accordance with a direction in which an illumination area IR extends. Therefore, the recording medium P that is transported on the opposing member 46 is more smoothly transported. The reflecting member 42 has an uneven surface including protruding reflecting surfaces 42*c* serving as reflecting surfaces 42*b* of the reflecting member 42.

In the heating device 40 having such a structure, since the recording medium P that is transported is transported while sliding on the opposing member 46 at all times, flapping of the recording medium P at the illumination area IR is suppressed, thereby making it easier to make uniform laser output in the illumination area IR. By using the opposing member 46, the illumination area IR is illuminated with laser light Li, and transmitted light transmitted through the recording medium P is reflected by the surface of the opposing member 46. Therefore, even in a mode in which a back-side reflecting member is not provided, the reflected transmitted light illuminates again the vicinity of the illumination area IR, so that fixing efficiency is increased.

The opposing member 46 may be rotated in accordance with the transportation of the recording medium P. The opposing member 46 is not limited to a round rod, and may be, for example, a flat member. The size of the opposing member 46 is a size that allows the illumination area IR to be formed. Although the opposing member 46 may be a metallic member as long as it is heat-resistant, it is desirable that thermal conductivity of the opposing member 46 be small so as to prevent heat from being emitted from the illumination area IR.

Further, although, in the exemplary embodiment, the laser light Li is applied to the illumination area IR from a substantially orthogonal direction, for example, as shown in FIG. 9, the laser light Li may be applied to the illumination area IR from an oblique direction.

Third Exemplary Embodiment

Figure 12:
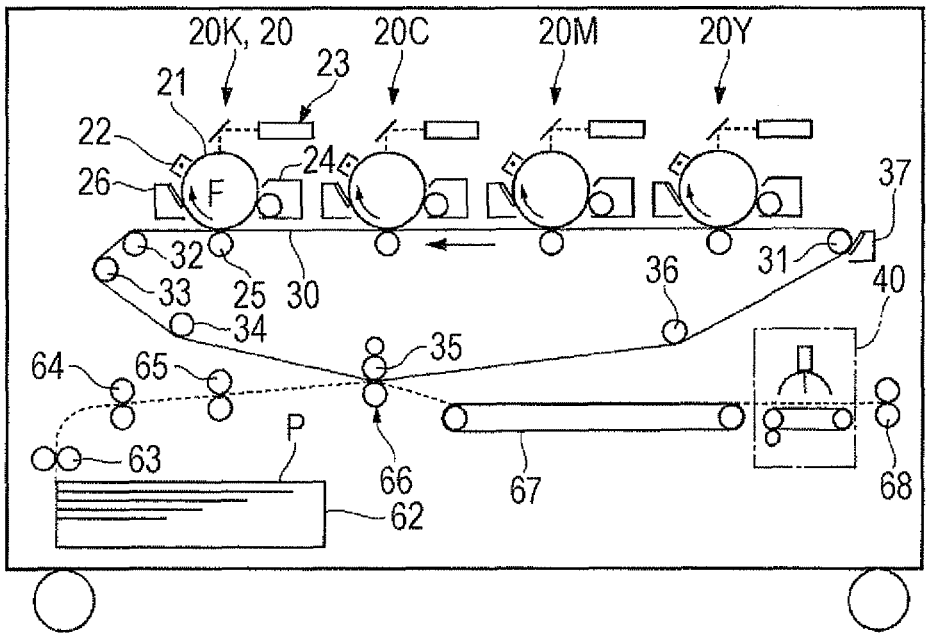
FIG. 12 schematically illustrates an image forming apparatus according to a third exemplary embodiment.

FIG. 12 schematically illustrates an image forming apparatus to which a heating device 40 is applied according to a third exemplary embodiment. The image forming apparatus according to the third exemplary embodiment differs from the image forming apparatus according to the first exemplary embodiment (see FIG. 2) in that it uses a cut sheet as a recording medium. Structural elements corresponding to those according to the first exemplary embodiment will be given the same reference numerals, and will not be described in detail here.

In FIG. 12, the image forming apparatus according to the third exemplary embodiment is, for example, an electrophotographic type. The image forming apparatus includes, for example, image forming units 20 for respective colors (more specifically, a black image forming unit 20K, a cyan image forming unit 20C, a magenta image forming unit 20M, and a yellow image forming unit 20Y), an intermediate transfer body 30, a single-transfer device (second transfer device 66), and a heating device 40. The image forming units 20 form images of the respective colors on the recording medium (cut sheet) P using, for example, toners of four different colors. The intermediate transfer body 30 is a belt that transports the multiplexed images of the respective colors formed by the image forming units 20 for the respective colors. The second transfer device 66 transfers the superimposed images on the intermediate transfer body 30 by a single operation to, for example, the recording medium P. The heating device 40 fixes unfixed images transferred to the recording medium P by the second transfer device 66.

Here, the image forming units 20 for the respective colors, which differ in that they use different toners, have substantially the same structure, and have structures that are similar to those of the image forming units 20 according to the first exemplary embodiment (see FIG. 2). Therefore, here, they will not be described in detail.

The intermediate transfer body 30 according to the exemplary embodiment is placed upon multiple tightly stretching rollers 31 to 36. For example, the tightly stretching roller 31 is a driving roller, and the tightly stretching roller 34 is a tension roller.

The second transfer device 66 is disposed with the tightly stretching roller 35 serving as a backup roller. A belt cleaning device 37 that cleans off any residual toner on the intermediate transfer body 30 is provided at a location opposing the tightly stretching roller 31 with the intermediate transfer body 30 being disposed therebetween.

Further, a recording medium holding unit 62 that holds recording media P is provided below the intermediate transfer body 30 in the image forming apparatus. Multiple transport rollers 63 to 65 are provided in a transport path of the recording media P that are transported from the recording medium holding unit 62. The transport rollers 63 to 65 are disposed between the recording medium holding unit 62 and the second transfer device 66. A transport belt 67 and discharge rollers 68 are also provided in the transport path of the recording media P. The transport belt 67 transports the recording medium P to which images have been transferred by a second transfer operation towards the heating device 40. The discharge rollers 68 discharge the recording medium P to which the images are fixed by the heating device 40 to the outside of the image forming apparatus.

Therefore, in the exemplary embodiment, superimposed images are formed on the intermediate transfer body 30 when images of respective colors formed on the photoconductor member 21 (that rotates in the direction of arrow F in FIG. 12) by the image forming units 20 for the respective colors are transferred to the intermediate transfer body 30 by a transfer device (first transfer device) 25. The recording medium P is transported to a second transfer position by, for example, the transport rollers 63 to 65 from the recording medium holding unit 62, and the images that have been superimposed at the intermediate transfer body 30 are transferred by a single operation to the recording medium P by the second transfer device 66. The recording medium P to which the multiplexed images have been transferred by the single operation by the second transfer device 66 is transported as it is by the transport belt 76, to fix the images by the heating device 40. The recording medium P to which the images have been fixed is discharged outside the image forming apparatus by the discharge rollers 68.

Figure 13:
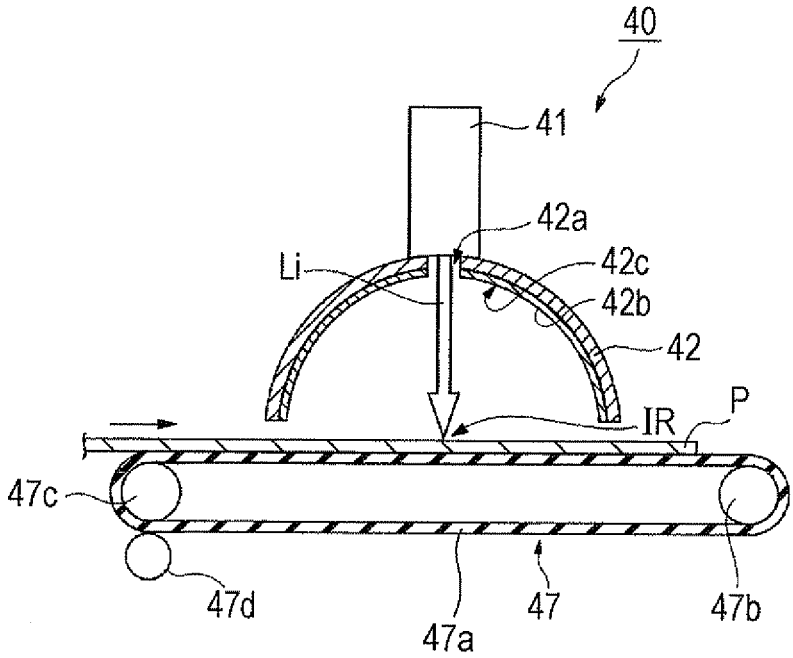
FIG. 13 schematically illustrates a heating device according to the third exemplary embodiment.

FIG. 13 schematically illustrates the heating device 40 according to the third exemplary embodiment. For example, an attracting transporting device 47 of an electrostatic attraction type that holds and transports the recording medium P is provided at a position opposing the reflecting member 42 with the recording medium P being disposed therebetween. It goes without saying that, as in the first exemplary embodiment, reflecting surfaces 42*b* are provided with protruding reflecting surfaces 42*c*.

The attracting transporting device 47 includes two roller members 47*b* and 47*c*, a belt member 47*a* that is placed around the two roller members 47*b* and 47*c* and that rotates, and a charging member 47*d* that charges the belt member 47*a*.

When the recording medium P to which the unfixed images are transferred reaches the heating device 40, the heating device 40 according to the exemplary embodiment is such that the belt member 47*a* of the attracting transporting device 47 is charged by the charging member 47*d*, so that the recording medium P is electrostatically attracted to the belt member 47*a*. The recording medium P attracted to the belt member 47*a* is transported as it is as the belt member 47*a* rotates. After laser light Li from an array laser 41 is applied to an illumination area IR, the recording medium P is transported further downstream. By providing a separating member that makes it easier to separate the recording medium P to which the images are fixed from the attracting transporting device 47, the recording medium P is easily separated from the belt member 47*a*.

In the exemplary embodiment, even if the recording medium P is a cut sheet, it is possible to stably maintain the orientation of the recording medium P at the illumination area IR by using the attracting transporting device 47. In addition, since the reflecting member 42 is provided with the protruding reflecting surfaces 42*c*, the illumination intensity of the laser light Li in the illumination area IR is substantially equalized with respect to the images, so that fixing efficiency is increased. Further, it is desirable for the belt member 47*a* used in the attracting transporting device 47 to have a surface that is capable of reflecting transmitted light, provided by applying the laser light Li at the illumination area IR and transmitted through the recording medium P, towards the back of the recording medium P, and to be formed of a material to which, for example, a white pigment is added.

Here, although a mode in which the charging member 47*d* contacts the belt member 47*a* is described, the belt member 47*a* may be charged using, for example, a corona electrical charger while it is separated from the belt member 47*a*. Although a mode in which the attracting transporting device 47 is an electrostatic attraction type is used, the attracting transporting device 47 may be a type that attracts the recording medium P from the back side of the belt member 47*a* by air suction. Further, although the belt member 47*a* is tightly stretched around the two roller members 47*b* and 47*c*, it is possible to provide, for example, an opposing member (such as a roller member) in correspondence with the illumination area IR and cause the vicinity of the illumination area IR to protrude towards the array laser 41.

Fourth Exemplary Embodiment

Figure 14A:
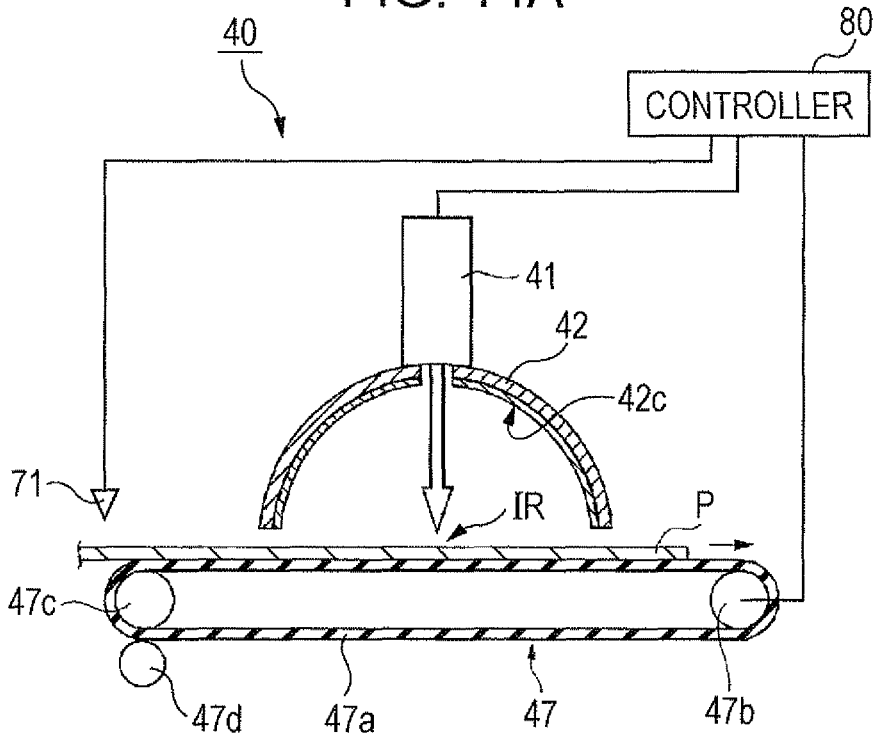
FIGS. 14A and 14B schematically illustrate a heating device according to a fourth exemplary embodiment.
Figure 14B:
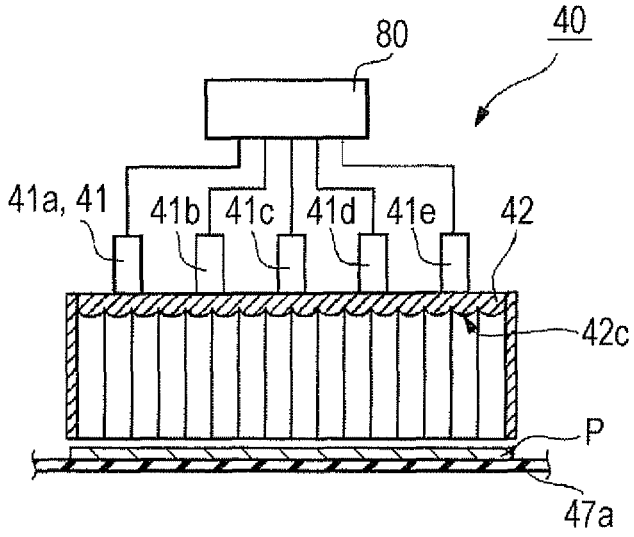

FIGS. 14A and 14B schematically illustrate a heating device 40 according to a fourth exemplary embodiment. FIG. 14A shows the heating device 40 as seen in a direction along a widthwise direction of a recording medium P. FIG. 14B shows the heating device 40 as seen along a direction of transportation of the recording medium P. The structure of the heating device 40 according to the fourth exemplary embodiment is substantially the same as that of the heating device 40 according to the third exemplary embodiment (see FIG. 13). It differs from the structure of the heating device 40 according to the third exemplary embodiment in that an output of an array laser 41 is controlled in accordance with image density of an image. Structural elements corresponding to those according to the third exemplary embodiment will be given the same reference numerals, and will not be described in detail here.

In the exemplary embodiment, a controller 80 that controls the output of the array laser 41 is provided. On the basis of image information, in accordance with image density of an image at an illumination area IR, the controller 80 adjusts illumination output of the array laser 41 (more specifically, high-output semiconductor lasers 41*a* to 41*e*). A sensor 71 that detects the position of a recording medium P is provided upstream from the illumination area IR in the direction of transportation of the recording medium P.

Figure 15:
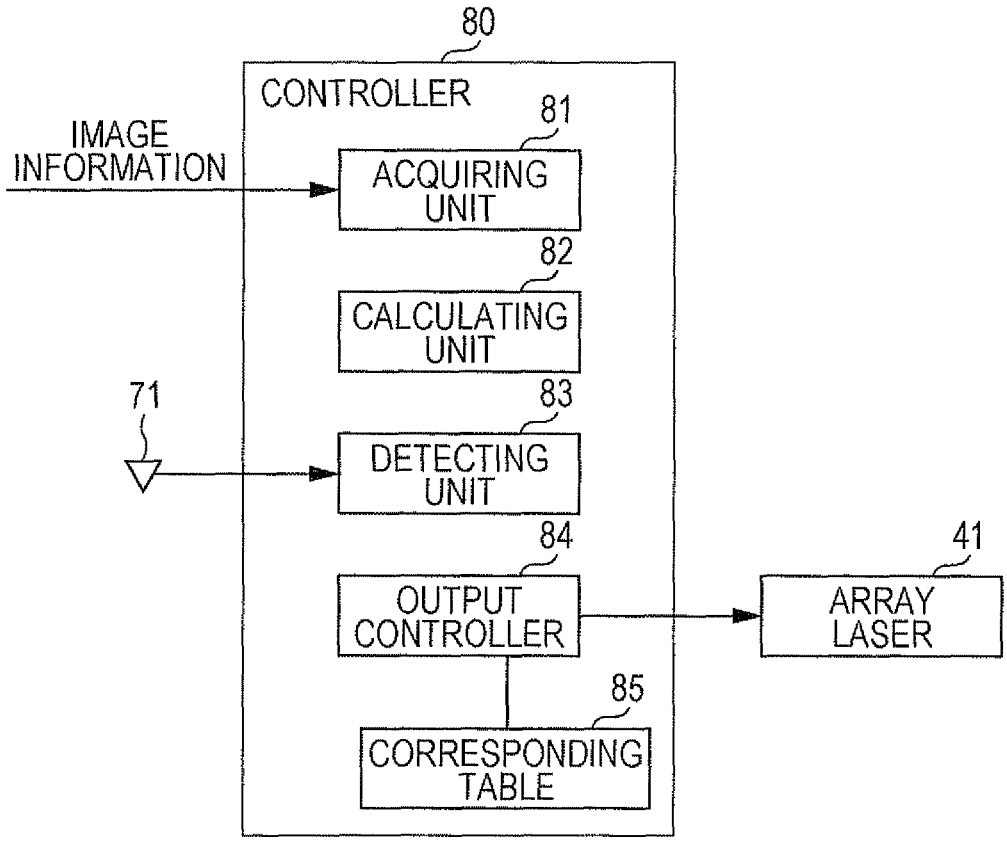
FIG. 15 is a block diagram of a controller according to the fourth exemplary embodiment.

The controller 80 according to the exemplary embodiment is as shown in FIG. 15. The controller 80 includes, for example, an acquiring unit 81, a calculating unit 82, a detecting unit 83, an output controller 84, and a corresponding table 85. The acquiring unit 81 acquires image information of an image formed on a recording medium P. The calculating unit 82 calculates image density of an image area corresponding to the illumination area IR from the image information acquired at the acquiring unit 81. On the basis of a signal from the sensor 71, the detecting unit 83 detects a timing at which the image area whose image density is calculated at the calculating unit 83 reaches the illumination area IR. The output controller 84 controls illumination output of the array laser 41 so that the illumination output of the array laser 41 is less than a set output, when the image density of the image area corresponding to the illumination area IR calculated at the calculating unit 82 is less than or equal to a predetermined reference value and when the corresponding image area has reached the illumination area IR according to the detecting unit 83. The corresponding table 85 is such that correspondences between the reference value and the illumination output are predetermined.

Figure 16:
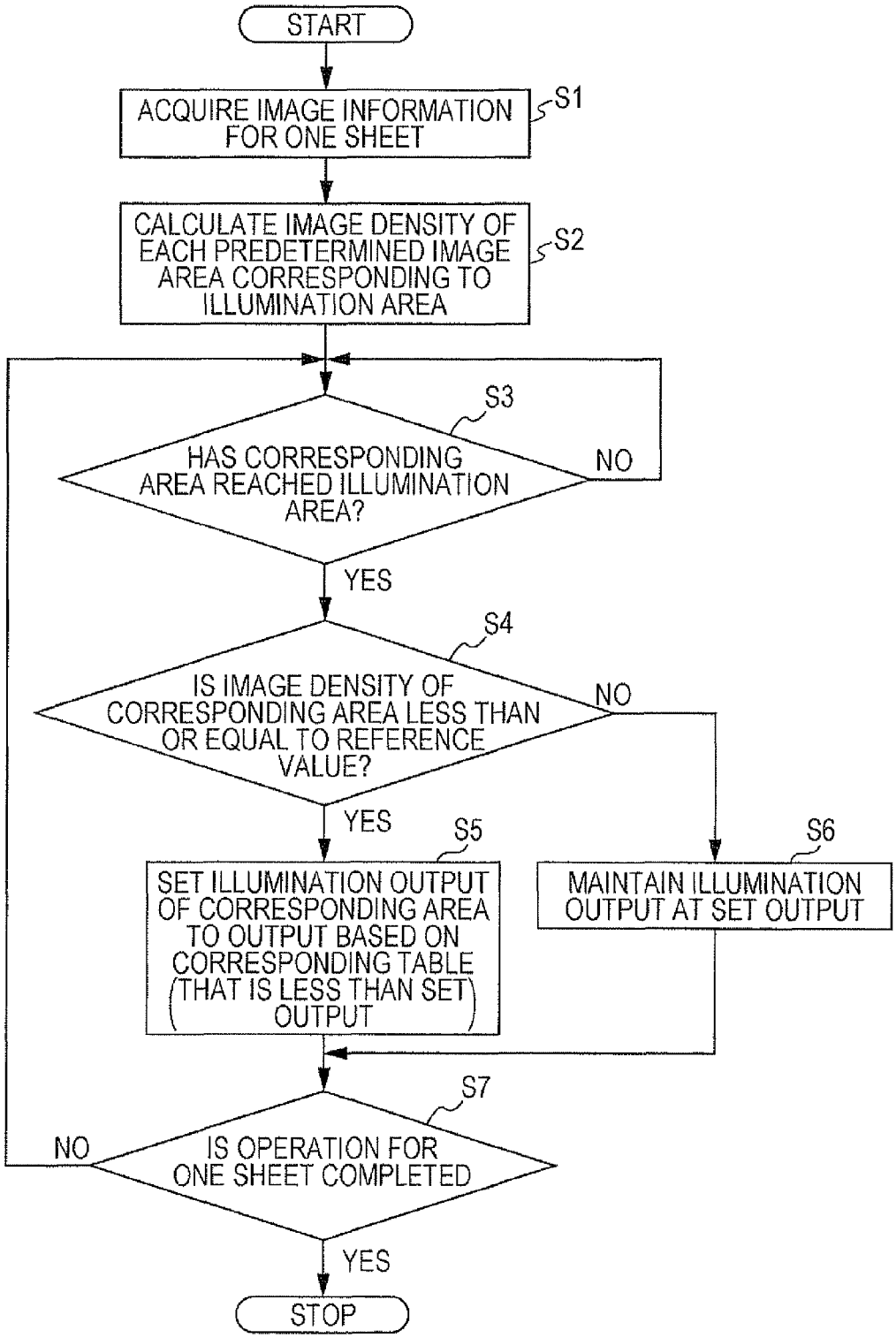
FIG. 16 is a flowchart of steps of control by the controller according to the fourth exemplary embodiment.

The flowchart of control by the controller 80 is as shown in, for example, FIG. 16. The acquiring unit 81 acquires image information for, for example, one sheet, and, on the basis of the acquired information, the calculating unit 82 calculates an image density for each predetermined image area corresponding to the illumination area IR (Steps S1 and S2). At this time, "each predetermined image area corresponding to the illumination area IR" may refer to the entire illumination area IR or to an illumination area IR that is segmented. Minimum areas correspond to illumination areas of the high-output semiconductor lasers 41*a* to 41*e*, respectively.

When the corresponding area whose image density has been calculated reaches the illumination area IR, and when the image density of the corresponding area calculated at the calculating unit 82 becomes less than or equal to the reference value, the output controller 84 sets the illumination output of the array laser 41 corresponding to the corresponding area to become an illumination output that is less than the set output (that is, an illumination output that is based on the corresponding table 85 (Steps S3 to S5). In contrast, if the image density of the corresponding area exceeds the reference value, the illumination output of the array laser 41 is maintained at the set output (Step S6). Then, such an operation is repeated for one sheet. If the operations for one sheet are completed, the process ends (Step S7).

By performing the control, for example, the quantity of reflected light Lr having a high intensity and reflected from the recording medium P is larger at an image having a low image density than at an image having a high image density, so that the quantity of reflected light Lr from the reflecting surfaces 42*b* of the reflecting member 42 also tends to increase accordingly. Therefore, the illumination intensity of the array laser 41 is reduced. In contrast, when, for example, a large solid image portion exists, the image density is high, thereby making it necessary to efficiently use the reflected light Lr from a portion where an image does not exist. In such a case, by increasing the illumination intensity of the laser light Li, the quantity of reflected light Lr from a portion that is far away from the image is increased, thereby providing a light quantity that is sufficient for a fixing operation.

Such reference value of an image density is not limited to one reference value. It is possible to predetermine several different reference values, set different illumination outputs within respective ranges, and store them in the corresponding table 85.

Further, if, for example, a reference value for each image for one sheet is predetermined, and the image is less than or equal to its reference value, illumination output when the image is fixed may be set lower than the set output. For example, if the image includes characters, the image density is ordinarily assumed to be on the order of 5%, in which case, adequate fixing is ensured even if the illumination output is low.

It is possible to divide an image for one sheet into multiple areas and to predetermine reference values at the respective areas. It goes without saying that the divided areas may be the same as those of the illumination area IR.

Modifications

Although, in the above-described exemplary embodiments, the array laser 41 and the reflecting member 42 (as well as the back-side reflecting member 43 in the mode in which the back-side reflecting member 43 is provided) are disposed, it is possible to incline the illumination area IR slightly along the widthwise direction of the recording medium P from the viewpoint of further increasing the effect of the protruding reflecting surfaces 42*c* of the reflecting member 42.

In general, if an image on a recording medium P is assumed to include, in particular, ruled lines and character strings, the percentage of the image that is consecutively disposed in the direction of transportation of the recording medium P or the widthwise direction of the recording medium P is high. When the illumination area IR is set along the widthwise direction of the recording medium P, the image density at the illumination area IR tends to be high. In contrast, if it is assumed that the illumination area IR is slightly inclined from the widthwise direction of the recording medium P, compared to the case in which the illumination area IR is set in the widthwise direction of the recording medium P, the image density is ordinarily low.

Figure 17:
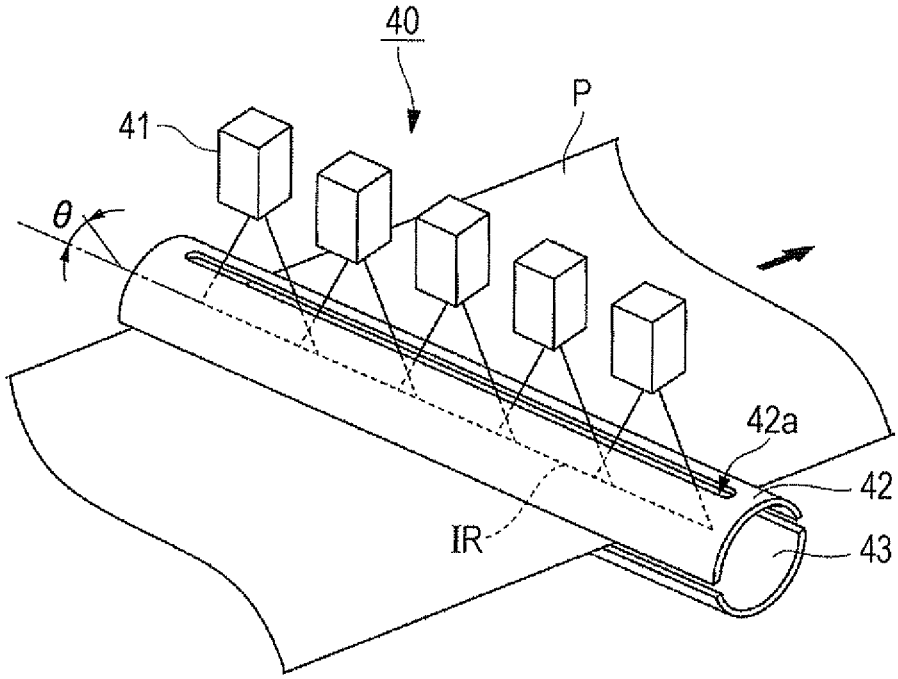
FIG. 17 is a perspective view of a modification of the heating device that is seen obliquely.

FIG. 17 is a perspective view of a modification of the heating device 40 that is seen obliquely. The heating device 40 according to the modification differs from the heating device 40 according to the first exemplary embodiment (see FIG. 3) in that the illumination area IR is inclined by an inclination angle θ from the widthwise direction of the recording medium P.

Therefore, in the modification, each array laser 41, a reflecting member 42, and a back-side reflecting member are laid out in accordance with the inclined illumination area IR.

Figure 18A:
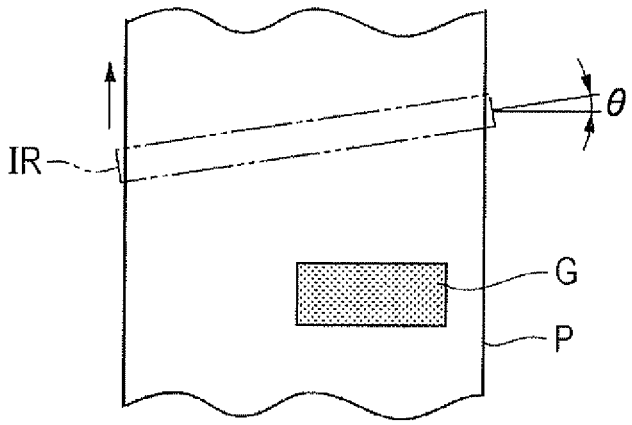
FIGS. 18A and 18B are each a schematic view showing an action at a position of an illustration area in a modification, with FIG. 18A showing a case in which the illumination area is inclined, and FIG. 18B showing a case in which the illumination area is not inclined.
Figure 18B:
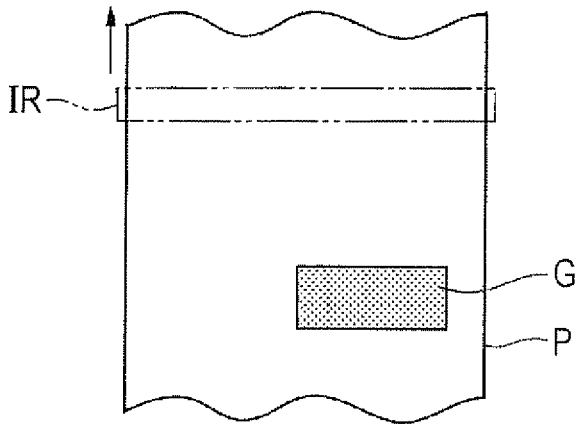

FIG. 18A shows a case in which, as in the modification, the illumination area IR is inclined by an inclination angle θ from a widthwise direction of a recording medium P. FIG. 18B is a schematic view showing a case in which the illumination area IR is disposed along the widthwise direction of the recording medium P. Here, if an illustrated image G is a solid image, since the solid image enters the illumination area IR in FIG. 18A, it successively enters the illumination area IR from a corner. Therefore, a portion where the image G does not exist tends to exist in the vicinity of the image G in the illumination area IR, and reflected light Lr having a high intensity and coming from the portion where the image G does not exist is efficiently used.

In contrast, as shown in FIG. 18B, if the illumination area IR is disposed along the widthwise direction of the recording medium P, when the image G enters the illumination area IR, the image G enters the illumination area IR in the same way in the widthwise direction of the recording medium P. Therefore, near the image G (in a direction along the widthwise direction of the recording medium P), only reflected light Lr from the vicinity of both ends of the image G is considerably used. Consequently, the illumination intensity in FIG. 18A is less than the illumination intensity in FIG. 18B.

Here, if the illumination area IR is inclined in this way, compared to the case in which the illumination area IR is not inclined, the illumination area IR becomes long in the longitudinal direction. As a result, it becomes necessary to increase the spreading of the laser light Li applied from the array laser 41, and to increase the number of high-output semiconductor lasers of the array lasers 41. Therefore, it is desirable to set the inclination angle θ to, for example, approximately a few degrees so as not to be too large.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A heating device comprising:

an illuminating unit that applies laser light towards a strip-like illumination area formed along a direction crossing a direction of movement of a recording medium; and a reflecting member that surrounds the illumination area, the reflecting member reflecting again reflected light from the illumination area, wherein the reflecting member has a plurality of protruding reflecting surfaces that protrude continuously towards the recording medium along a widthwise direction crossing a longitudinal direction of the illumination area, the protruding reflecting surfaces being disposed side by side in the longitudinal direction of the illumination area, and wherein the protruding reflecting surfaces are positioned at substantially equal distances from the illumination area along the widthwise direction of the illumination area, and changed so that an entire or a portion of a cross-sectional shape along the longitudinal direction of the illumination area is curved or inclined.

2. The heating device according to claim 1, wherein the plurality of protruding reflecting surfaces are continuously formed adjacent to each other in the longitudinal direction of the illumination area.

3. The heating device according to claim 1, wherein the plurality of protruding reflecting surfaces are discontinuously formed so as to be separated from each other in the longitudinal direction of the illumination area.

4. The heating device according to claim 1, wherein the cross-sectional shape is selected from a curved shape, a V shape, and a trapezoidal shape.

5. The heating device according to claim 1, further comprising a back-side reflecting member that is provided at a back-side portion that opposes the reflecting member with the recording medium being disposed therebetween, the back-side reflecting member reflecting again transmitted light of the laser light towards the recording medium, the transmitted light being transmitted through the recording medium, the laser light being applied from the illuminating unit.

6. The heating device according to claim 1, wherein the illuminating unit applies the laser light to the illumination area that is inclined with respect to a predetermined image disposition reference direction along a widthwise direction of the recording medium crossing the direction of movement of the recording medium.

7. The heating device according to claim 1, further comprising an acquiring unit that acquires image information of the image formed on the recording medium;

a calculating unit that calculates image density of an image area corresponding to the illumination area from the image information acquired at the acquiring unit;

a detecting unit that detects a timing at which the image area whose image density is calculated at the calculating unit reaches the illumination area; and an output controller that controls illumination output of the illuminating unit so that the illumination output of the illuminating unit is less than an output for when the image density calculated at the calculating unit exceeds a predetermined reference value, when the image density of the image area corresponding to the illumination area calculated at the calculating unit is less than or equal to the predetermined reference value and when the timing is detected at the detecting unit.

8. An image forming apparatus comprising:

a transporting unit that transports a recording medium;

an image forming unit that forms an image that is fixable by heating on the recording medium; and the heating device according to claim 1 that fixes the image formed on the recording medium at the image forming unit.

9. The image forming apparatus according to claim 7, wherein the recording medium is continuous along a direction of transportation.

10. The image forming apparatus according to claim 8, wherein the plurality of protruding reflecting surfaces of the heating device are continuously formed adjacent to each other in the longitudinal direction of the illumination area.

11. The image forming apparatus according to claim 8, wherein the plurality of protruding reflecting surfaces of the heating device are discontinuously formed so as to be separated from each other in the longitudinal direction of the illumination area.

12. The image forming apparatus according to claim 8, wherein the cross-sectional shape of each protruding reflecting surface of the heating device is selected from a curved shape, a V shape, and a trapezoidal shape.

13. The image forming apparatus according to claim 8, wherein the heating device further includes a back-side reflecting member that is provided at a back-side portion that opposes the reflecting member with the recording medium being disposed therebetween, the back-side reflecting member reflecting again transmitted light of the laser light towards the recording medium, the transmitted light being transmitted through the recording medium, the laser light being applied from the illuminating unit.

14. The image forming apparatus according to claim 8, wherein the illuminating unit of the heating device applies the laser light to the illumination area that is inclined with respect to a predetermined image disposition reference direction along a widthwise direction of the recording medium crossing the direction of movement of the recording medium.

15. The image forming apparatus according to claim 8, further comprising an acquiring unit that acquires image information of the image formed on the recording medium;

a calculating unit that calculates image density of an image area corresponding to the illumination area from the image information acquired at the acquiring unit;

a detecting unit that detects a timing at which the image area whose image density is calculated at the calculating unit reaches the illumination area; and an output controller that controls illumination output of the illuminating unit so that the illumination output of the illuminating unit is less than an output for when the image density calculated at the calculating unit exceeds a predetermined reference value, when the image density of the image area corresponding to the illumination area calculated at the calculating unit is less than or equal to the predetermined reference value and when the timing is detected at the detecting unit.

* * * * *